US008708838B2

(12) United States Patent
Ferguson et al.

(10) Patent No.: US 8,708,838 B2
(45) Date of Patent: Apr. 29, 2014

(54) HOLLOW GOLF CLUB WITH HIGH DENSITY WEIGHTS

(75) Inventors: Gentry Ferguson, Encinitas, CA (US); Takeshi Casey Funaki, San Diego, CA (US); Keisuke Yamane, Laguna Niguel, CA (US)

(73) Assignee: Acushnet Company, Fairhaven, MA (US)

( * ) Notice: Subject to any disclaimer, the term of this patent is extended or adjusted under 35 U.S.C. 154(b) by 145 days.

(21) Appl. No.: 13/487,294

(22) Filed: Jun. 4, 2012

(65) Prior Publication Data

US 2013/0005501 A1 Jan. 3, 2013

Related U.S. Application Data

(63) Continuation-in-part of application No. 13/173,245, filed on Jun. 30, 2011, now Pat. No. 8,608,589.

(51) Int. Cl.
*A63B 53/04* (2006.01)

(52) U.S. Cl.
USPC ..... 473/335; 473/334; 473/337; 473/338; 473/345

(58) Field of Classification Search
USPC ..... 473/334, 335, 337, 338, 345
See application file for complete search history.

(56) References Cited

U.S. PATENT DOCUMENTS

| | | | | |
|---|---|---|---|---|
| 4,795,159 | A | 1/1989 | Nagamoto | |
| 4,824,110 | A | 4/1989 | Kobayashi | |
| 5,501,459 | A | 3/1996 | Endo | |
| 5,935,019 | A | 8/1999 | Yamamoto | |
| 6,033,321 | A | 3/2000 | Yamamoto | |
| 6,123,627 | A * | 9/2000 | Antonious | 473/327 |
| 6,162,132 | A | 12/2000 | Yoneyama | |
| 6,203,448 | B1 | 3/2001 | Yamamoto | |
| 6,379,265 | B1 | 4/2002 | Hirakawa et al. | |
| 7,090,061 | B2 | 8/2006 | Bove et al. | |
| 7,101,291 | B2 | 9/2006 | Yamamoto | |
| 7,326,472 | B2 | 2/2008 | Shimazaki et al. | |
| 7,572,194 | B2 * | 8/2009 | Yamamoto | 473/334 |
| 2002/0004428 | A1 * | 1/2002 | Takeda | 473/338 |
| 2005/0009627 | A1 * | 1/2005 | Willett et al. | 473/338 |
| 2010/0331103 | A1 * | 12/2010 | Takahashi et al. | 473/338 |

* cited by examiner

*Primary Examiner* — Benjamin Layno
(74) *Attorney, Agent, or Firm* — Randy K. Chang

(57) ABSTRACT

A golf club with a new innovative construction to attach a high density weight to an external surface of the sole of a golf club head is disclosed herein. More specifically, the present invention relates to utilizing a thickened sole portion having a specific surface area to thickness ratio to provide adequate support for a high density weight having a significant amount of mass. The new innovative method of attachment also incorporates a unique mechanical lock to properly secure the high density weight to the club head, as materials used for high density weighting may not be easily weldable to the titanium material currently used for metalwood type golf club head.

18 Claims, 10 Drawing Sheets

HOLLOW GOLF CLUB WITH HIGH DENSITY WEIGHTS

CROSS REFERENCE TO RELATED APPLICATION

The present application is a Continuation-In-Part of U.S. patent application Ser. No. 13/173,245, filed on Jun. 30, 2011, now U.S. Pat. No. 8,608,589, the disclosure of which is hereby incorporated by reference in its entirety.

FIELD OF THE INVENTION

The present invention relates generally to an innovative construction to attach high density weights to a golf club head. More specifically, the present invention relates to an innovative construction to attach high density weights to an external surface of a golf club head wherein the materials used for the high density weight doesn't lend itself well to the traditional attachment method of welding.

BACKGROUND OF THE INVENTION

Ever since the golf industry has shifted away from persimmon wood type golf clubs into the modern metal wood type golf clubs, golf club engineers have always tinkered with the weight distribution of the golf club head in order to improve the performance of the golf club head. Because the modern day metal wood golf clubs are generally made out of a lightweight titanium type of material, they may not be able to shift a significant amount of weight around the golf club head. In order to address the weighting deficiencies of titanium, golf club engineers have attempted to attach higher density metallic materials to the body of the titanium golf club head.

U.S. Pat. No. 4,824,110 to Kobayashi shows one of the earlier attempts at combining different materials having different specific gravity to form a golf club head in order to adjust the weighting distribution of the golf club head. Moreover, U.S. Pat. No. 4,824,110 focuses on the usage of fiber reinforced plastic as the lightweight material while using traditional titanium or steel as the heavy weighted material. Although the usage of fiber reinforced plastic is one way to achieve significant discretionary weight within a golf club head, it does so at the expense of some other performance characteristics such as the sound of the golf club at impact.

Despite all of the design advantages associated with the fiber reinforced plastic, the usage of completely metallic golf club head is still preferred by much of the golfing public for its superior sound characteristics. The problem with the titanium material used to create a metal wood type golf club head is that it may not always join well together with materials such as tungsten, molybdenum, or zirconium; all of which have a higher density than titanium. U.S. Pat. No. 5,935,019 to Yamamoto recognizes this issue and identifies this issue by saying that "it is difficult to weld together metals of different types, and especially difficult when one of the metals is titanium or a titanium alloy." U.S. Pat. No. 5,935,019 addresses this bonding issue by forming a metallic hollow golf club head with a sole plate molded form a light metal and formed with a fitting hole, and a weighted structure comprising a weight of a heavy metal press-fitted into a ring-shaped spacer formed of the same light metal as the sole plate, said weighted structure being fitting into the fitting hole, and the ring-shaped spacer and the sole plate being welded together.

U.S. Pat. No. 6,379,265 to Hirakawa et al. illustrates another attempt to joint two metallic materials together in a golf club head to improve the performance. More specifically, U.S. Pat. No. 6,379,265 illustrates a metal wood club including a sole plate and a weight body which is fastened to this sole plate via a spacer. A recess which accommodates the spacer and weight body is formed in a portion of the sole plate, and undercut part is formed in the inside circumferential portion of the recess, and a circumferential groove is formed in the outer circumferential portion of the weight body. When the weight body is press-fitted in the recess with the spacer in between, the spacer is forcibly engaged with the undercut part and circumferential groove, thus allowing the weight body to be firmly fastened to the recess of the sole plate of the club head.

Despite all of the attempts to attach high density weights to a metallic golf club head, most of these attempts utilize crude press-fitting techniques that do not allow the materials to bond together in a clean fashion. Moreover, the press-fitting techniques discussed above do not help limit the relative rotation of the heavy density weight with respect to the golf club head, which could lead to undesirable rattling. Hence, it can be seen from above there is a need in the field for a golf club head that is capable of joining together a heavy density metallic material together with a lower density metallic material in a manner that not only provides a clean and aesthetically pleasing joint, but also in a way that prohibits the rotation and vibration of the weight itself.

BRIEF SUMMARY OF THE INVENTION

In one aspect of the present invention is a hollow metalwood type golf club head comprising a striking face portion, a body portion, a thickened sole portion, and a weight. The striking face portion is located at a frontal portion of the golf club head. The body portion is connected to an aft portion of the striking face portion. The thickened sole portion is connected to a sole cavity of the body portion, wherein the thickened sole portion has a surface area to thickness ratio of less than about 1000.0 mm; the surface area to thickness ratio is defined as the surface area of the thickened sole portion divided by a thickness of the thickened sole portion. The weight is attached to an external surface of the thickened sole portion. The golf club head has a density ratio of greater than about 2.0, wherein the density ratio is defined as a density of the weight divided by a density of the body portion. Finally, the attachment of the weight to the thickened sole portion utilizes a mechanical lock.

In another aspect of the present invention is a hollow metalwood type golf club head comprising a striking face portion, a body portion, a thickened sole portion, and a weight. The striking face portion is located at a frontal portion of the golf club head. The body portion is connected to an aft portion of the striking face portion. The thickened sole portion is connected to a sole cavity of the body portion. The weight is attached to an external surface of the thickened sole portion. The attachment of the weight to the thickened sole portion utilizes a mechanical lock, wherein the mechanical lock further comprises a protruding extension stemming from the weight, and an attachment socket located within an internal cavity of the golf club head, adapted to engage the protruding extension; wherein the protruding extension and the attachment socket engages one another to secure the weight to the thickened portion of the golf club head.

In a further aspect of the present invention is a hollow metalwood type golf club head comprising a striking face portion, a body portion, a thickened sole portion, and a weight. The striking face portion is located at a frontal portion of the golf club head. The body portion is connected to an aft portion of the striking face portion. The thickened sole portion is connected to a sole cavity of the body portion, wherein the thickened sole portion has a surface area to thickness ratio of less than about 1000.0 mm; the surface area to thickness ratio is defined as the surface area of the thickened sole portion divided by a thickness of the thickened sole portion. The weight is attached to an external surface of the thickened sole portion, wherein the weight has a mass of between about 10 grams to about 40 grams. Finally, the attachment of the weight to the thickened sole portion utilizes a mechanical lock.

These and other features, aspects and advantages of the present invention will become better understood with references to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
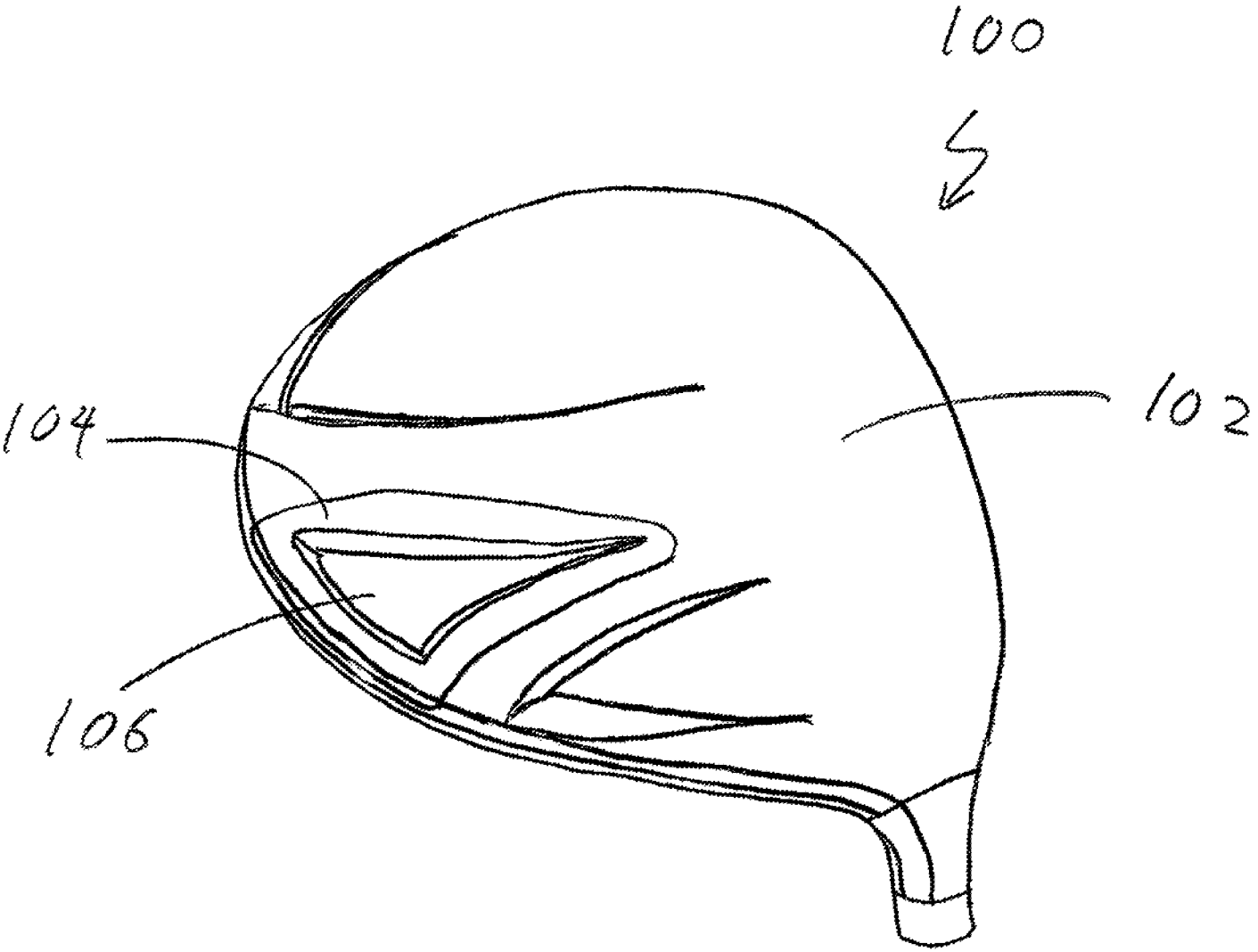
FIG. 1 shows a perspective view of a golf club head in accordance with an exemplary embodiment of the present invention.

FIG. 1 of the accompanying drawings shows a perspective view of a golf club head 100 in accordance with an exemplary embodiment of the present invention. More specifically, FIG. 1 of the accompanying drawings shows the golf club head 100 being constructed out of four different components, a striking face portion 101, a body portion 102, a thickened sole portion 104, and a weight 106. The usage of the four different components within this current exemplary embodiment of the present invention is generally used to allow the current golf club head 100 to incorporate a weight 106 at a strategic location identified in FIG. 1. In order to understand the proper functionality of the four different components, and the reason to have the four different components, it is worthwhile to begin a discussion about the material properties of each of the components.

Like previously mentioned, the modern age metal wood type golf club head may generally be constructed out of a titanium material, to which it is difficult to weld any high density materials. Following that theme, the body portion 102 of the golf club head 100 in accordance with the current exemplary embodiment may generally be constructed out of a lightweight titanium type material for its high strength and low weight properties. The titanium material used to construct the body portion 102 may generally have a density of about 4.5 g/cc; however numerous other types of metallic material with high strength-to-weight ratio could be used without departing from the current scope and content of the present invention so long as they have a density of between about 4.0 g/cc and about 5.0 g/cc.

Weight 106, as discussed in this current exemplary embodiment of the present invention, may generally be made out of a material that has a higher density than the titanium material used to construct the body portion 102 in order to provide a more noticeable change to the weighting properties of the golf club head 100. More specifically, weight 106 may generally be constructed out of a tungsten type material have a density of about 17.0 g/cc; however numerous other materials such as molybdenum, zirconium, tantalum, brass, copper, gold, or even platinum could all be used without departing from the scope and content of the present invention so long as they have a density that is greater the density of the body portion 102 of the golf club head 100. Alternatively speaking, the material used for the weight 106 may generally have a density of greater than about 9.0 g/cc, more preferably greater than about 9.5 g/cc, and most preferably greater than about 10.0 g/cc all without departing from the scope and content of the present invention.

Given the need of the weight 106 to dramatically change the weighting properties of the golf club head 100, the requirement that the density of the weight 106 be greater than about twice that of the density of the body portion 102 will generally yield a "density ratio" of greater than about 2.0, more preferably greater than about 2.1, most preferably greater than about 2.2. The density ratio, as referred to in the current exemplary embodiment of the present invention, is defined by Equation (1) below:

$$\text{Density Ratio} = \frac{\text{Density of Weight (106)}}{\text{Density of Body Portion (102)}} \qquad \text{Eq. (1)}$$

Finally, the golf club head 100 shown in FIG. 1 also incorporates a thickened sole portion 104. Because the overall mass of the weight 106 is so high relative to the portion of the golf club head 100 that it is attached to, combined with the fact that it is generally desirable to keep the wall thickness of the body 102 as thin as possible to reduce unnecessary weight; the thinned body portion 102 may generally lack sufficient thickness to support the mass of weight 106. Hence, in order to increase the stability of the attachment of the weight 106 to the golf club head 100, a thickened sole portion 104 is created to reinforce the interface between the weight 106 and the body portion 102.

The thickened sole portion 104, as discussed in this current exemplary embodiment of the present invention, may generally be formed out of the same material as the material used to form the body portion 102 of the golf club head. Having the thickened sole portion 104 formed out of the same material as the body portion 102 allows for the two components to be attached easily to one another using traditional attachment methodologies such as welding. However, thickened sole portion 104 may be formed out of a material that is substantially similar to, or completely different from the body portion 102 material without departing from the scope and content of the present invention, so long at the materials can be easily joined together.

Figure 2:
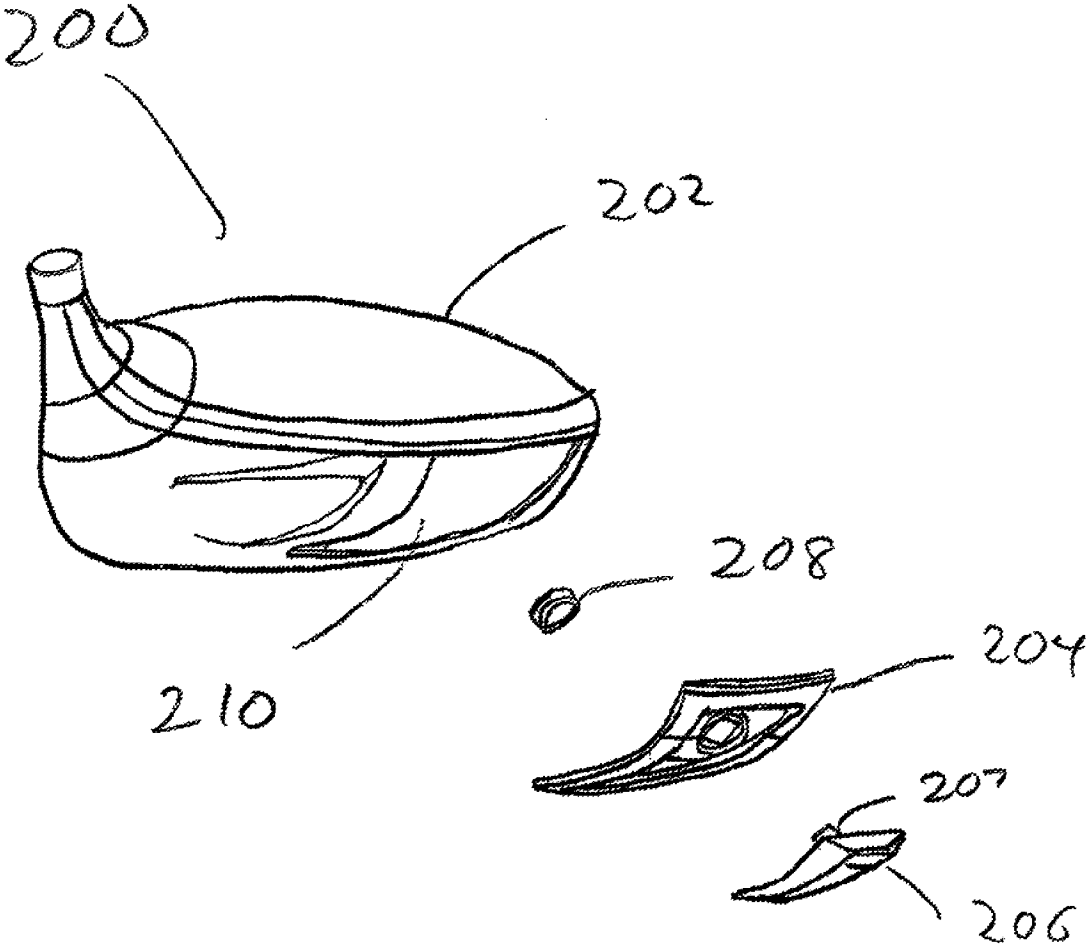
FIG. 2 shows an exploded perspective view of a golf club head in accordance with an exemplary embodiment of the present invention.

FIG. 2 of the accompanying drawings that shows an exploded view of the golf club head 200 to provide a better illustration of the relationship amongst the various components. In addition to the golf club head 200, the body portion 102, the thickened sole portion 204, and the weight 106, FIG. 2 also shows a locking nut 208 and a sole cavity 210. This exploded view also illustrates how the weight 206 incorporates a protruding extension 207 that extends into the internal cavity of the golf club head 200 to engage a locking nut 208 to form a "mechanical lock". It is worth noting here that the material used to form the locking nut 208 may generally be titanium, as it is a material that can be easily welded and joined to the thickened sole portion 204; however, the locking nut 208 may also be formed out of an alternative material without departing from the scope and content of the present invention so long as it is formed out of a material that can easily bond to the base material of the thickened sole portion 204. The usage of this mechanical lock is important to the proper functionality of the current invention because, as previously mentioned, the material used to create the weight 206 may not join well to the material used to form the remainder of the body portion 202.

Locking nut 208, as shown in FIG. 2 of the accompanying drawings, may generally refer to one part of the "mechanical lock" that works in conjunction with the protruding extension 207 of the weight 206 to secure the weight 206 to the thickened sole portion 204. In fact, in a more general term, the locking nut 208 may be referred to as an attachment socket to refer to any other types of attachment mechanism that completes the "mechanical lock" without departing from the scope and content of the present invention. However, due to the extreme impact conditions a golf club head 200 experiences during impact with a golf ball, the mere threaded locking connection between the locking nut 208 and the protruding extension 207 may become lose over time; resulting in a weight 206 that can easily fall apart from the golf club head 200. The current invention, in order to further strengthen the connection and bond between the weight 206 and the actual club head 200, has made the locking nut 208 out of the same material as the remainder of the body portion 202 and the thickened sole portion 204. Having the locking nut 208 made out of the same material as the remainder of the golf club head 200 allows the locking nut 208 to be welded to the remainder of the thickened sole portion 204, further increasing the bond strength of the weight 206 to the golf club head 200.

It is worth re-emphasizing here that the implementation of the mechanical lock together with a weldable locking nut 208 is only necessary because the weight 206 itself can not be easily welded together, requiring the addition of these mechanical components. The current invention, in order to create sufficient bond strength, utilizes both a mechanical lock mechanism with titanium components to allow welds to be used to accomplish a secure bond between the golf club head 200 and the high density weight 206.

Finally, FIG. 2 of the accompanying drawings shows an opening on the sole of the golf club head 200, to which the thickened sole portion 204 may generally be attached to the body 202 of the golf club head 200. The opening created by the sole cavity 210, may generally have a geometry that substantially matches the geometry of the thickened sole portion 204 to allow the thickened sole portion 204 to cover up the sole cavity 210. The bond between the thickened sole portion 204 and the body portion 202 may generally be accomplished via conventional welding techniques, as the discussion above has already indicated that both components are made out of generally the same weldable material such as titanium.

Figure 3:
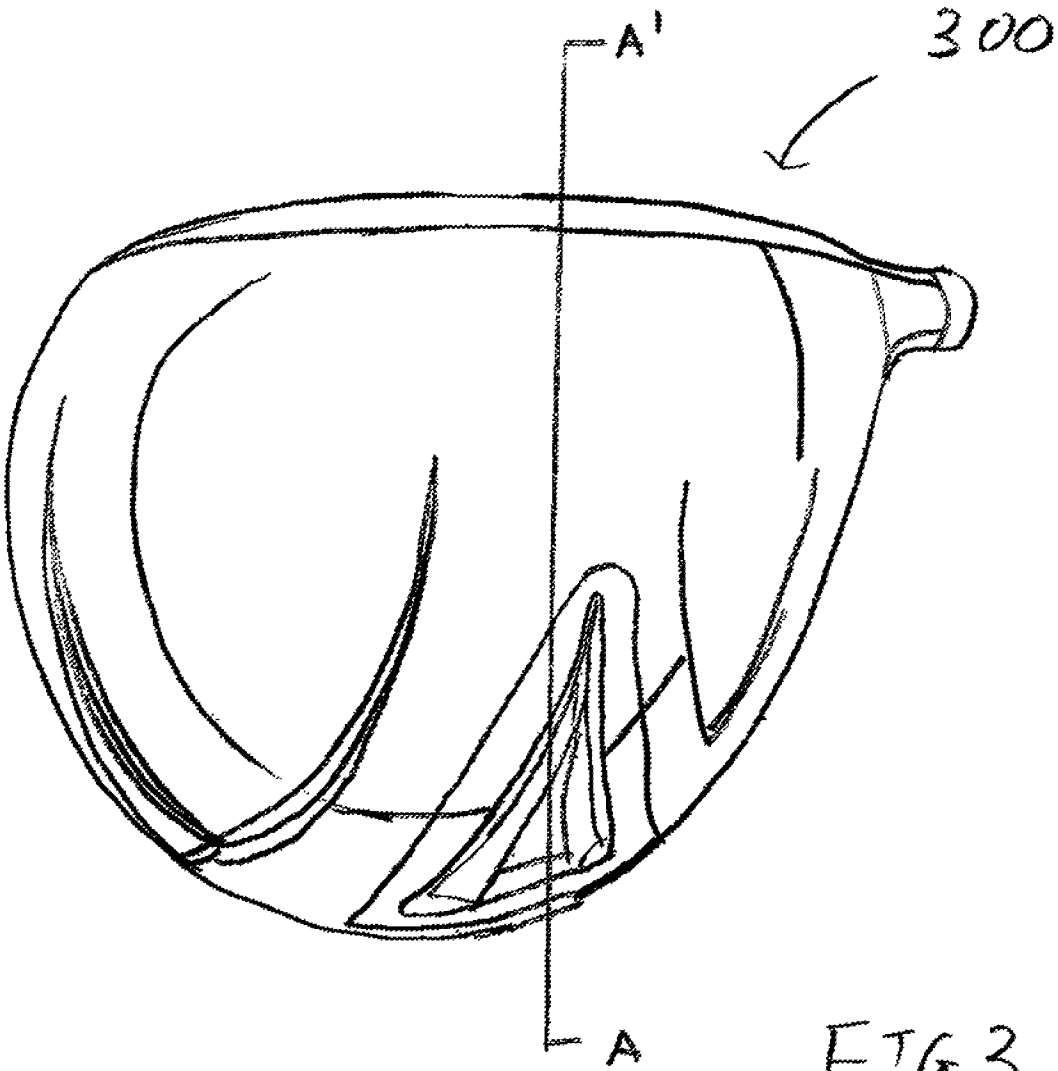
FIG. 3 shows a sole view of a golf club head in accordance with an exemplary embodiment of the present invention illustrating cross-sectional line A-A'.

FIG. 3 of the accompanying drawings shows a sole view of a golf club head 300 in accordance with an exemplary embodiment of the present invention. The sole view of the golf club head 300 shown in FIG. 3 allows cross-sectional line A-A' to be shown, from which a cross-sectional view can be created in FIG. 4.

Figure 4:
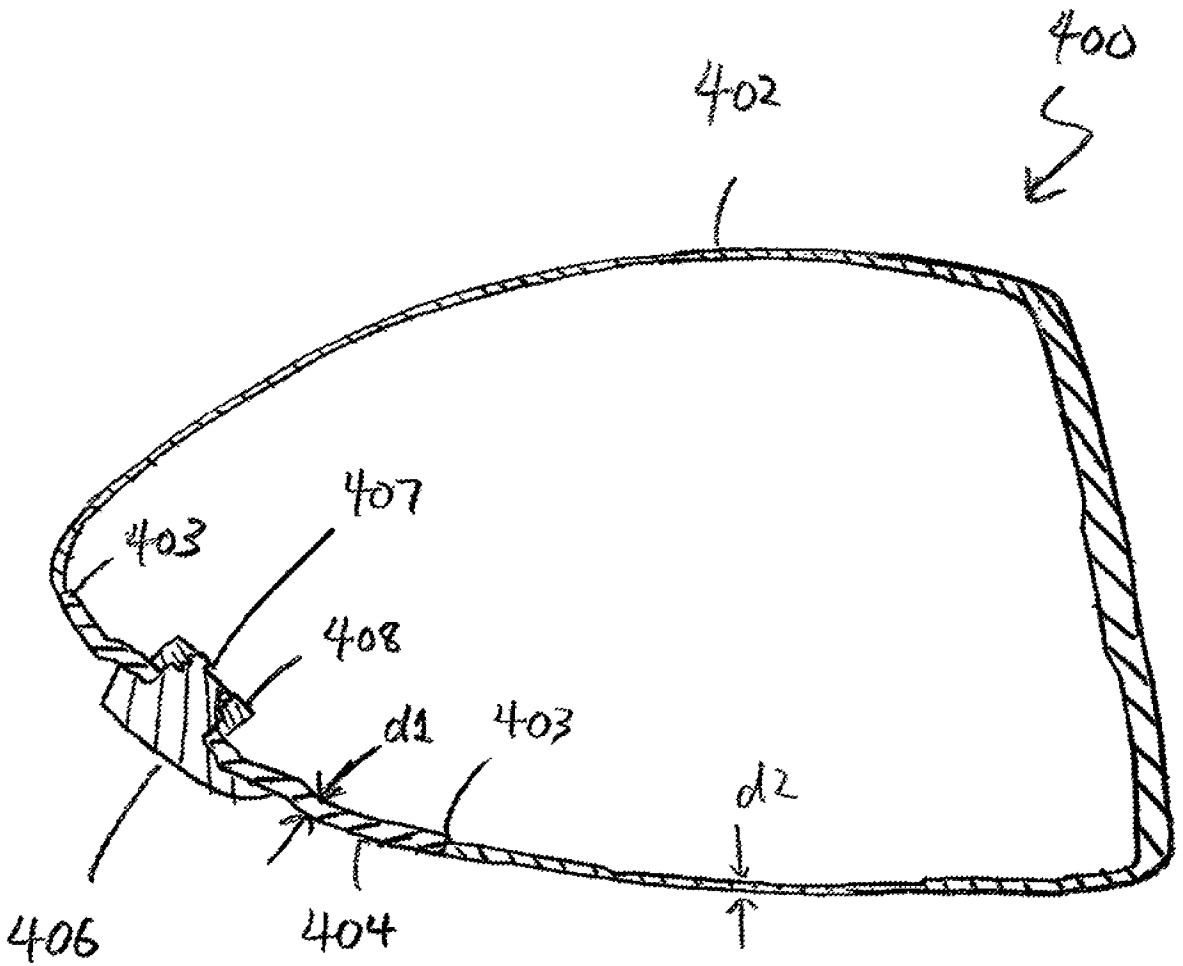
FIG. 4 shows a cross-sectional view of a golf club head in accordance with an exemplary embodiment of the present invention, taken along cross-sectional line A-A' shown in FIG. 3.

FIG. 4 of the accompanying drawings provide a cross-sectional view of the golf club head 400 taken along cross-sectional line A-A' shown in FIG. 3. More specifically, the cross-sectional view of golf club head 400 shows how the body portion 402, the thickened sole portion 404, the weight 406, and the locking nut 408 all interface with one another to complete the golf club head 400. FIG. 4 shows that the thickened sole portion 404 may generally have a wall thickness that is significantly thicker than the thickness of the remainder of the body portion 402, despite the fact that both of these components may be made out of the same material. The purpose of increasing the thickness of the thickened sole portion 404 is to provide more structural rigidity to the portion of the golf club head 400 that the weight 406 attaches to. The minimal thickness d1 of the thickened sole portion 404 in this current exemplary embodiment of the present invention may generally be greater than about 1.60 mm, more preferably greater than about 1.65 mm, and most preferably greater than about 1.70 mm. However, the absolute thickness d1 of the thickened sole portion 404 may not be indicative of the requisite thickness for the thickened sole portion 404; due to the fact that the thickness required may generally be a function of the surface area of the thickened sole portion 404 itself. Hence, in order to more precisely quantify the thickness requirement of the thickened sole portion, a surface area to thickness ratio is defined below by Equation (2):

$$\text{Surface Area to Thickness Ratio} = \frac{\text{Surface Area}}{\text{Thickness}} \qquad \text{Eq. (2)}$$

The surface area to thickness ratio of the thickened sole portion 404 in accordance with the current exemplary embodiment of the present invention may generally be less than about 1000.0 mm, more preferably less than about 969.0 mm, and most preferably less than about 941.0 mm; with the total surface area of the thickened sole portion being approximately 1600 $mm^2$.

In addition to the surface area to thickness ratio, the thickness of the thickened sole portion 404 can also be defined as a function of the remainder of the sole of the thin body portion 402. In this current exemplary embodiment of the present invention, the thickness d2 of the sole in the thinned body portion 402 may generally be less than about 0.75 mm, more preferably less than about 0.65 mm, and most preferably less than about 0.55 mm. Given the relative thickness discussed above, it can be said that the thickest part of the sole d1 of the golf club head is generally more than about 1.5 times the thinnest part of the sole d2, more preferably greater than 1.75 times, and most preferably greater than 2.0 times. Alternatively speaking, a ratio of the thickness d1 of the thickened sole portion 404 divided by the thickness d2 of the thinnest portion of the sole of the body portion 402 is generally greater than about 1.5, more preferably greater than about 1.75, and most preferably greater than about 2.0.

Like prior discussions have indicated, the weight 406 used in this current exemplary embodiment of the present invention may generally be constructed out of a heavy weight high density material that carries significant mass. More specifically, the weight 406 discussed in this current invention may generally have a mass of between about 10 grams and about 40 grams, more preferably between about 15 grams and about 25 grams, and most preferably about 20 grams. Having such a heavy weight 406 may generally mean that the momentum generated by the weight 406 during a golf swing could cause significant stress on the attachment mechanism. Hence, in order to ensure that the weight 406 is securely attached to the golf club head 400, all while preserving the minimal amount of weight for the remainder of the golf club head 400, the present invention has constructed a thickened sole portion 404 to which the weight 406 can easily attach.

FIG. 4 of the accompanying drawings also shows the interface amongst all of the components of the mechanical lock, including the weight 406 and the locking nut 408. Although not shown in detail, FIG. 4 of the accompanying drawings is intended at showing that the protruding extension 407 and the locking nut 408 engage one another using threads. Although these types of threaded mechanical lock may generally be the preferred mechanical lock methodology, it is not the only type of mechanical lock that can be used. In fact, other types of mechanical locks such as dovetails, undercuts, wedge fits, press fits, or even spring fits may be used without departing from the scope and content of the present invention so long as it provides a mechanical lock that secures the weight 406 to the club head 400.

Figure 5:
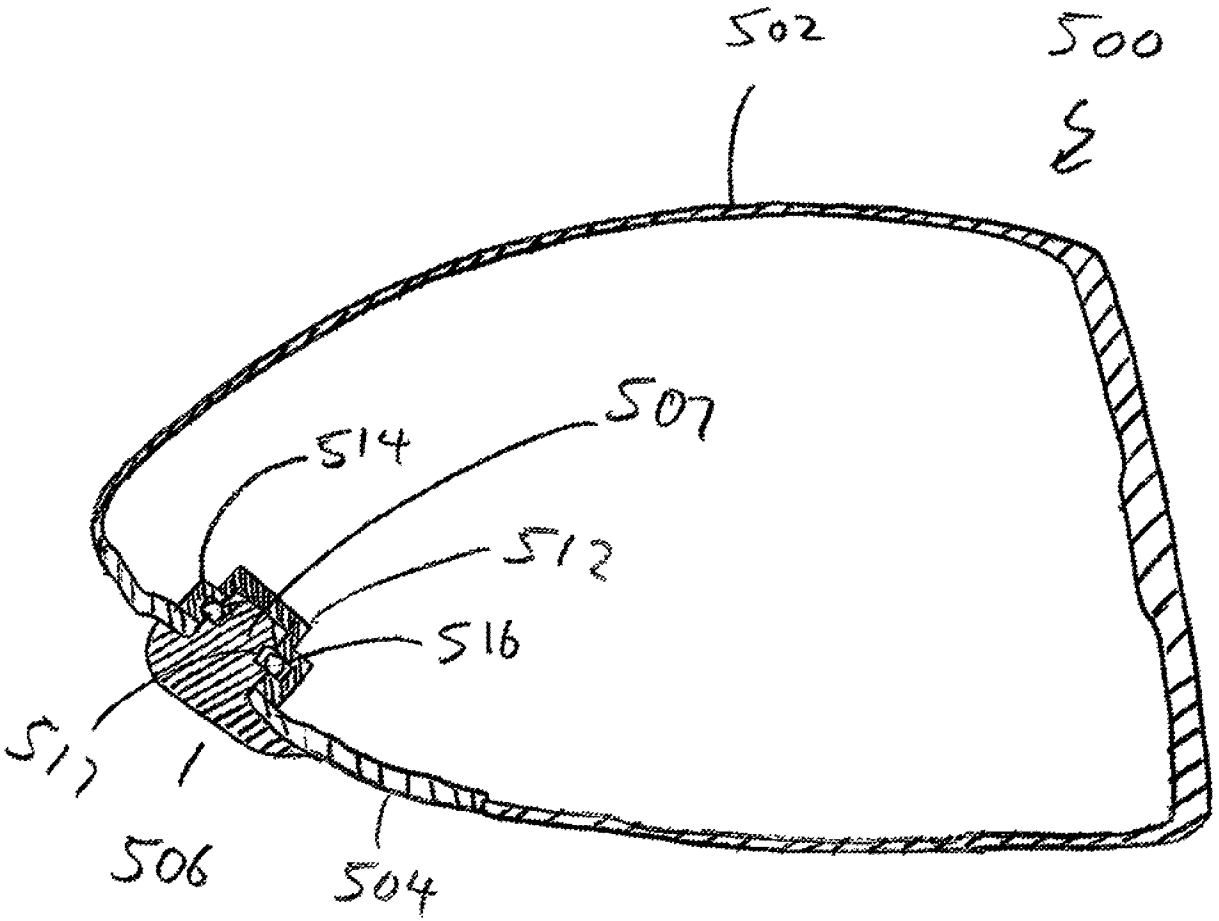
FIG. 5 shows a cross-sectional view of a golf club head in accordance with an alternative embodiment of the present invention, taken along cross-sectional line A-A' shown in FIG. 3.

FIG. 5 of the accompanying drawings shows a cross-sectional view of a golf club head 500 in accordance with an alternative embodiment of the present invention, taken along the same cross-sectional line A-A' shown in FIG. 3. The alternative embodiment of the present invention shown in FIG. 5 utilizes a different "mechanical lock" mechanism to secure the weight 506 to the golf club head 500. More specifically, the "mechanical lock" mechanism shown in this embodiment may generally comprise of a weight socket 512 having locking channel 516, a protruding extension 507 having a complimentary channel 517, and a snap ring 514. The locking channel 516 of the weight socket 512 encircles the protruding extension 507 of the weight 508 to work in conjunction with a complimentary channel 517 formed on the protruding extension 507 to create an oversized channel around the weight 506. To complete the "mechanical lock" a snap ring 514 is wedged in between the locking channel 516 and the complimentary channel 517, securing the weight 506 to the body portion 502 of the golf club head 500. The snap ring 514 shown in this current exemplary embodiment of the present invention may generally be a metallic ring that expands to allow the weight 506 to be inserted into the weight socket 512, and contracts to prevent any outward movement of the weight 506.

Similar to the locking nut 208 shown above in FIG. 2, the weight socket 512 may also be referred to more generally as an attachment socket that engages the protruding extension 507 to secure the weight 506 to the club head 500 without departing from the scope and content of the present invention.

Figure 6:
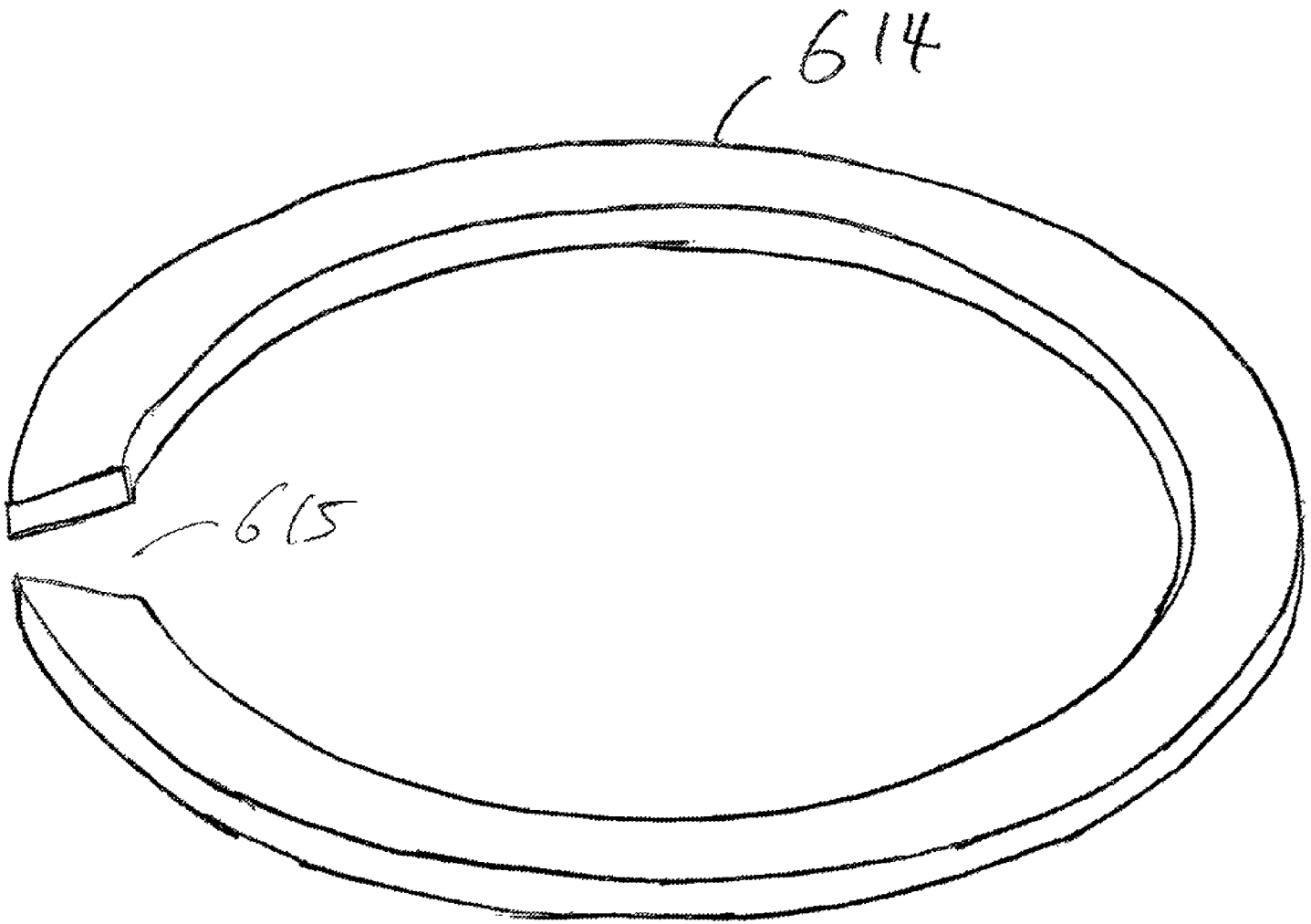
FIG. 6 shows a perspective view of a snap ring used in accordance with an alternative embodiment of the present invention.

FIG. 6 of the accompanying drawings shows an enlarged perspective view of the snap ring 614 in accordance with an exemplary embodiment of the present invention, as the snap ring 514 in FIG. 5 was too small to show sufficient detail. The snap ring 614 may generally have an opening 615 near one of its circular ends, allowing the snap ring 614 to increase and decrease its inner diameter to hold the weight 506 within it's place within the golf club head 500. (both shown in FIG. 5). Snap ring 614, as shown in the current exemplary embodiment of the present invention, could be flat, round, or any other shape that is capable of capturing the weight 506 without departing from the scope and content of the present invention. More information regarding the basic functionality of a snap ring can be found in U.S. Pat. No. 7,090,061, the disclosure of which is incorporated by reference in its entirety.

Figure 7:
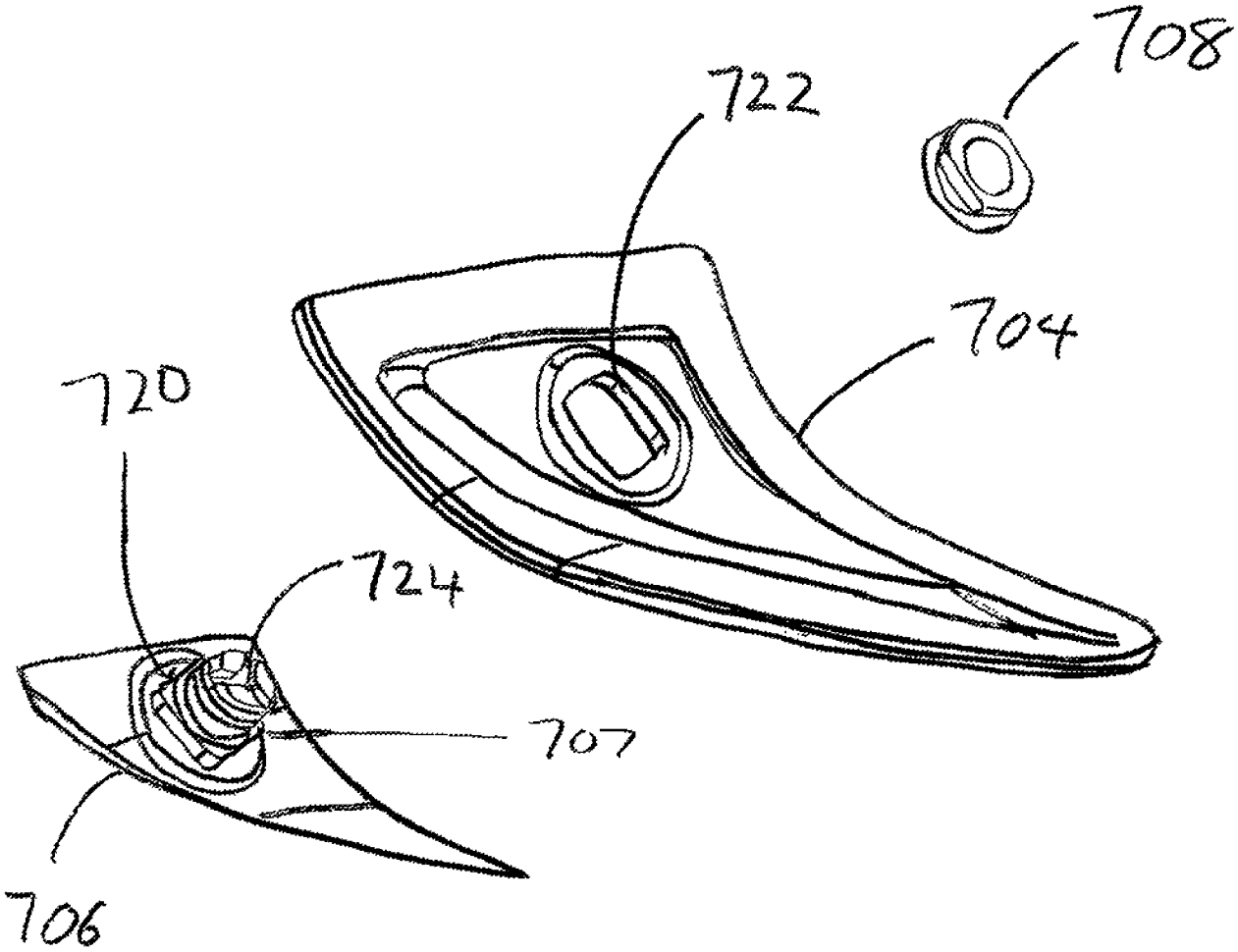
FIG. 7 shows an exploded perspective view of a mechanical lock attachment mechanism in accordance with an exemplary embodiment of the present invention.

FIG. 7 of the accompanying drawings show an enlarged exploded perspective view of the weight 706, the thickened sole portion 704, and the locking nut 708. This exploded view shown in FIG. 7 allows an "anti-rotation components" between the weight 706 and the thickened sole portion 704 to be shown with more clarity. More specifically, the "anti-rotation components" shown in this exemplary embodiment of the present invention includes an oversized base 720 at the base of the protruding extension 707 and an opening 722 on the thickened sole portion 704, which work in conjunction with one another to prohibit the rotation of the weight 706, once it is attached to the thickened sole portion 704. The oversized base 720 and its congruently shaped opening 722 work together to further strengthen the mechanical lock created by the threaded protruding extension 707 and the locking nut 708 by limiting the relative rotation of one component from the other, which can cause any threaded mechanical lock to become loose. Although the shape of the oversized base 720 is shown to be square in shape, oversized base 720 can be rectangular, octagonal, hexagonal, polygonal, or it can take on any other shape that contains a corner to prohibit the rotation of the weight 706 relative to the thickened sole portion 704 without departing from the scope and content of the present invention.

In addition to the "anti-rotation components" used to enhance the bond of the mechanical lock between the weight 706 and the thickened sole portion 704, FIG. 7 of the accompanying drawings shows a plurality of weld grooves 724 located at the terminal end of the protruding extension 707 that can also be used to enhance the bond. The plurality of weld grooves 724, as shown in the current exemplary embodiment of the present invention, may generally provide a channel or groove for the weld beads to run longitudinally from one end of the protruding extension 707 to another end of the protruding extension 707, strapping the locking nut 708 to the thickened sole portion 706. Because rotational mechanical locks such as the threaded mechanism shown in FIG. 7 could easily loosen itself when subjected to numerous impact vibrations, the added plurality of weld grooves 724 strengthens that bond by further limiting the rotation of the locking nut 708 relative to the weight 706.

Figure 8:
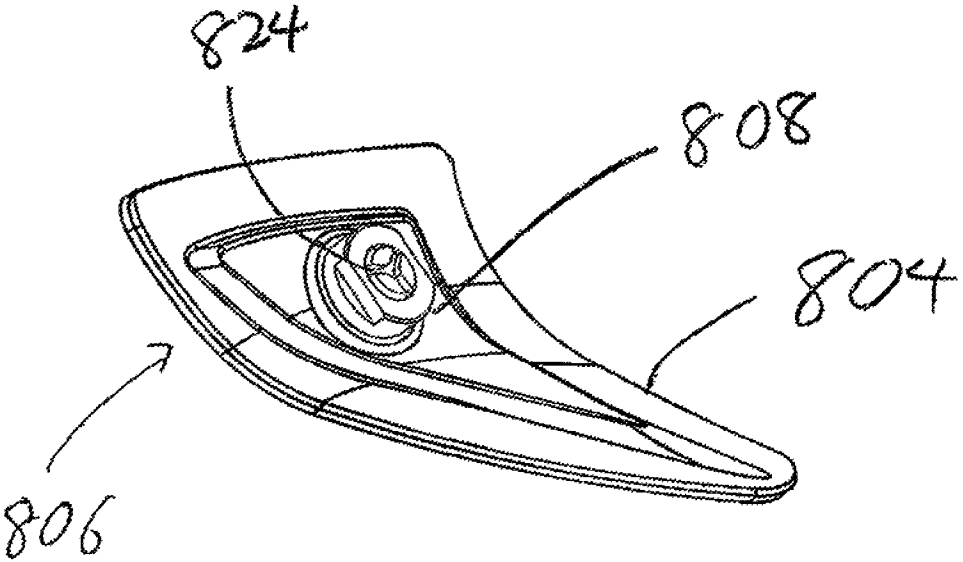
FIG. 8 shows an assembled perspective view of the mechanical lock attachment mechanism in accordance with an exemplary embodiment of the present invention.

The integration of the plurality of weld grooves 724 into the thickened sole portion 704 and the locking nut 708 can be shown more clearly in FIG. 8 of the accompanying drawings, providing an assembled perspective view of the weight 806, thickened sole portion 804, and the locking nut 808. More specifically, it can be seen that once the entire weight assembly is put together, the plurality of weld grooves 824 can be seen to extend out from the locking nut 808, allowing the weldable components to be welded together to complete the attachment of the weight 806 to the thickened sole portion 804.

Figure 9:
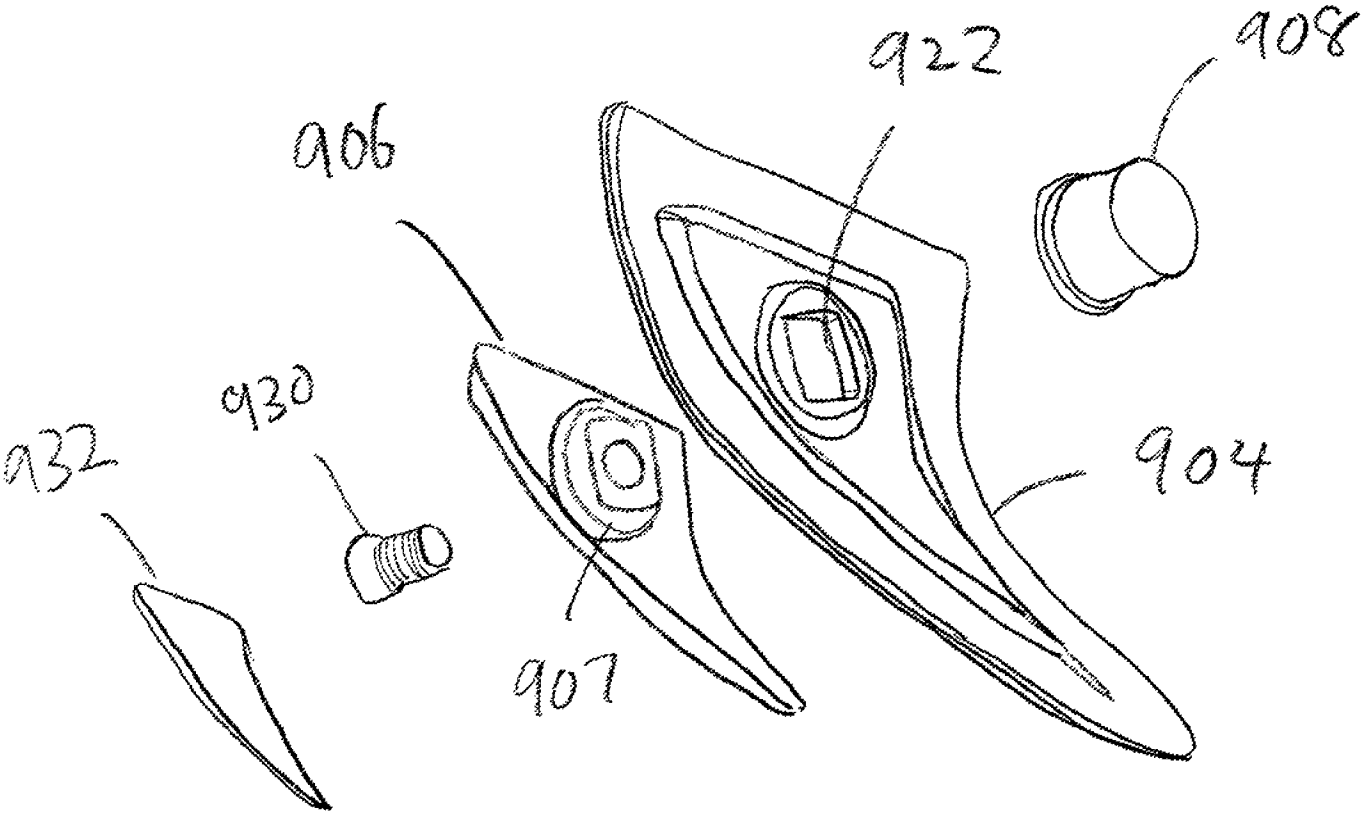
FIG. 9 shows an exploded perspective view of a mechanical lock attachment mechanism in accordance with an alternative embodiment of the present invention.

FIG. 9 of the accompanying drawings shows an exploded perspective view of the mechanical lock attachment mechanism in accordance with a further alternative embodiment of the present invention. More specifically, in this alternative embodiment of the present invention, the mechanical lock attachment mechanism utilizes a separate screw 930 that attaches to the weight 906 instead of forming a threaded mechanism directly on top of the weight 906. In addition to the incorporation of the screw 930, this alternative embodiment of the present invention also utilizes different shape locking nut 908 to secure the components together. Finally, in this alternative embodiment of the present invention, the mechanical lock attachment mechanism includes a cover 932 to the external edge of weight 906 to conceal the screw 930. The uniqueness of this embodiment of the present invention derives its benefit from the interface between the weight 906 and the thickened sole portion 904, as practical applications have shown that in some rare circumstances, the minor manufacturing tolerance differences of the various components could cause the weight 906 to crack and break under certain conditions.

Figure 10:
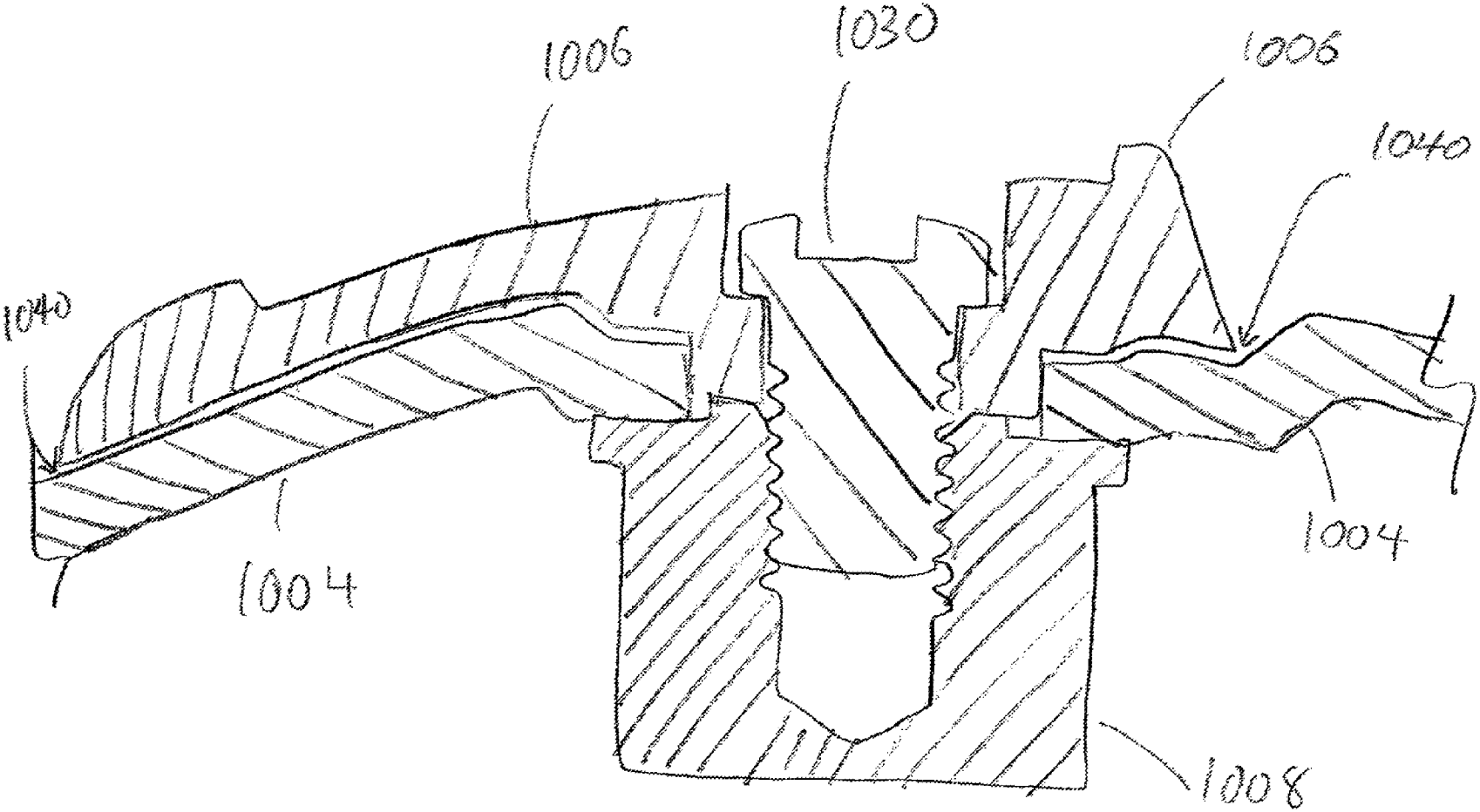
FIG. 10 shows an enlarged cross-sectional view of a golf club head's mechanical lock attachment mechanism taken along cross-sectional line A-A' in accordance with an alternative embodiment of the present invention.

In order to more accurately demonstrate the interface between the weight 906 and the thickened sole portion 904, FIG. 10 is provided illustrating a cross-sectional view of the mechanical lock attachment mechanism. More specifically, FIG. 10 illustrates the same components as those shown in FIG. 9, but is capable of showing a gap 1040 between the weight 1006 and the thickened sole portion 1004. Like the prior discussion already indicated, it is almost impossible to get a perfect fit between the weight 1006 and the thickened sole portion 1004 due to manufacturing tolerances. Hence, in order to address the issue, the present embodiment creates a counter-intuitive solution to expand the distance of the gap 1040 to be greater than about 0.10 mm and less than about 0.50 mm to allow for a vibration dampening material to be placed in between the two components. In fact, in a more preferred embodiment, the distance of the gap 1040 may be greater than about 0.15 mm and less than about 0.50 mm, more preferably greater than about 0.20 mm and less than about 0.50 mm, all without departing from the scope and content of the present invention. The addition of the vibration dampening material within the gap 1040 helps the weight 1006 from chattering with the thickened sole portion 1004, which prevents cracks and breakage.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting form the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A hollow metalwood type golf club head comprising:

a striking face portion located at a frontal portion of said golf club head;

a body portion connected to an aft portion of said striking face portion;

said body portion further comprises a thinned sole portion and a thickened sole portion, and a weight attached to an external surface of said thickened sole portion, wherein a gap of greater than about 0.10 mm and less than about 0.50 is maintained between said thickened sole portion and said weight, wherein said golf club head has a density ratio of greater than about 2.0, said density ratio is defined as a density of said weight divided by a density of said body portion.

2. The hollow metalwood type golf club head of claim 1, wherein said gap distance is greater than about 0.15 mm and less than about 0.50 mm.

3. The hollow metalwood type golf club head of claim 2, wherein said gap distance is greater than about 0.20 mm and less than about 0.50 mm.

4. The hollow metalwood type golf club head of claim 1, wherein said weight is attached to said thickened sole portion via a mechanical lock.

5. The hollow metalwood type golf club head of claim 4, wherein said mechanical lock further comprises;

a screw protruding out from said weight; and an attachment socket located within an internal cavity of said golf club head, adapted to engage said screw, wherein said screw and said attachment socket engages one another to secure said weight to said thickened portion of said golf club head.

6. The hollow metalwood type golf club head of claim 1, wherein said density of said weight is greater than about 9.0 g/cc.

7. The hollow metalwood type golf club head of claim 6, wherein said density of said body portion is between about 4.0 g/cc and about 5.0 g/cc.

8. The hollow metalwood type golf club head of claim 1, wherein said gap is filled with a vibration dampening material.

9. The hollow metalwood type golf club head of claim 1, wherein a minimal thickness of said thickened sole portion is greater than about 1.60 mm.

10. The hollow metalwood type golf club head of claim 9, wherein said minimal thickness of said thickened sole portion is greater than about 1.65 mm.

11. The hollow metalwood type golf club head of claim 10, wherein said minimal thickness of said thickened sole portion is greater than about 1.70 mm.

12. A hollow metalwood type golf club head comprising:

a striking face portion located at a frontal portion of said golf club head;

a body portion connected to an aft portion of said striking face portion;

said body portion further comprises a thinned sole portion and a thickened sole portion, and a weight attached to an external surface of said thickened sole portion, wherein a gap of greater than about 0.10 mm and less than about 0.50 is maintained between said thickened sole portion and said weight, wherein a ratio of the thickness of said thickened sole portion divided by the thickness of said thinned sole portion is greater than about 1.5.

13. The hollow metalwood type golf club head of claim 12, wherein said ratio of the thickness of said thickened sole portion divided by the thickness of said thinned sole portion is greater than about 1.75.

14. The hollow metalwood type golf club head of claim 12, wherein said ratio of the thickness of said thickened sole portion divided by the thickness of said thinned sole portion is greater than about 2.0.

15. The hollow metalwood type golf club head of claim 12, wherein a minimal thickness of said thickened sole portion is greater than about 1.60 mm.

16. The hollow metalwood type golf club head of claim 12, wherein said minimal thickness of said thickened sole portion is greater than about 1.65 mm.

17. The hollow metalwood type golf club head of claim 12, wherein said minimal thickness of said thickened sole portion is greater than about 1.70 mm.

18. The hollow metalwood type golf club head of claim 12, wherein said gap is filled with a vibration dampening material.

* * * * *